US006593555B2

(12) United States Patent
Hayashi

(10) Patent No.: US 6,593,555 B2
(45) Date of Patent: Jul. 15, 2003

(54) HEATING UNIT OF CARBON FIBER-MIXED SHEET

(75) Inventor: Yukiko Hayashi, Sakai (JP)

(73) Assignee: Kyoko Hayashi, Sakai (JP)

( * ) Notice: Subject to any disclaimer, the term of this patent is extended or adjusted under 35 U.S.C. 154(b) by 54 days.

(21) Appl. No.: 09/984,172

(22) Filed: Oct. 29, 2001

(65) Prior Publication Data

US 2002/0074329 A1 Jun. 20, 2002

(30) Foreign Application Priority Data

Oct. 31, 2000 (JP) ..... 2000-007815

(51) Int. Cl.[7] ..... H05B 3/10

(52) U.S. Cl. ..... 219/553; 219/528; 219/545; 219/548; 219/549

(58) Field of Search ..... 219/553, 211, 219/212, 213, 217, 528, 529, 544, 545, 548, 549; 428/137; 338/311; 392/425, 432, 435, 408

(56) References Cited

U.S. PATENT DOCUMENTS

| | | | | |
|---|---|---|---|---|
| 4,434,023 A | | 2/1984 | Kanamori et al. | 156/307.3 |
| 4,490,828 A | * | 12/1984 | Fukuhara et al. | 219/553 |
| 4,698,485 A | | 10/1987 | Barkley et al. | |
| 4,960,979 A | * | 10/1990 | Nishimura | 219/549 |
| 4,990,755 A | * | 2/1991 | Nishimura | 219/553 |
| 5,030,282 A | * | 7/1991 | Matsuhashi et al. | 219/553 |
| 5,237,155 A | | 8/1993 | Hill | |
| 5,331,134 A | | 7/1994 | Kimura | |
| 5,459,327 A | * | 10/1995 | Nomura | 392/408 |
| 5,582,757 A | * | 12/1996 | Kio et al. | 219/548 |
| 5,616,266 A | | 4/1997 | Cooper | |
| 5,741,456 A | * | 4/1998 | Ayrton | 428/137 |
| 5,781,100 A | * | 7/1998 | Komatsu | 338/311 |
| 6,051,812 A | | 4/2000 | Walker | |
| 6,057,532 A | * | 5/2000 | Dexter et al. | 219/553 |
| 6,501,056 B1 | * | 12/2002 | Hirohata et al. | 219/553 |

FOREIGN PATENT DOCUMENTS

| | | |
|---|---|---|
| JP | 57-92777 | 6/1982 |
| JP | 62-160681 | 7/1987 |
| JP | 5-258842 | 10/1993 |
| JP | 5-326112 | 12/1993 |
| JP | 7-46630 | 5/1995 |
| JP | 7-240271 | 9/1995 |
| JP | 9-260034 | 10/1997 |
| JP | 11-40327 | 2/1999 |

* cited by examiner

*Primary Examiner*—Teresa Walberg
*Assistant Examiner*—Fadi H. Dahbour
(74) *Attorney, Agent, or Firm*—Armstrong, Westerman & Hattori, LLP.

(57) ABSTRACT

The purpose is to provide a heating unit of a carbon fiber-mixed sheet with a low price in which sheet carbon fibers are equally dispersed and a member on the surface of which sheet is not subjected to such change of properties as discoloration and the like. The constitution is characterized in that a sizing agent covers a part of the carbon fiber-mixed sheet which sheet is made by the mixed fiber-making of 5~10 wt. % of a carbon fiber having a length of 5~10 mm and 95~90 wt. % of a pulp containing a bast fiber and in that the sheet has a thickness of 150 $\mu$m or less, a basis weight of 50 g/m$^2$ or less and a degree of beating of 30~70° SR.

5 Claims, 4 Drawing Sheets

HEATING UNIT OF CARBON FIBER-MIXED SHEET

BACKGROUND OF THE INVENTION

1. Field of the Invention

This invention relates to a heating unit of a carbon fiber-mixed sheet which sheet is produced by the mixed sheet-making of a carbon fiber along with a plant pulp, especially with a pulp containing a bast fiber.

2. Description of the Prior Art

Petroleum and gas-burners and electric heating appliances have gained a wide application as heating units. Planar heaters using electric heating such as panel heaters have also been used as appliances for local heating. Among such planar heaters using electric heating, heaters for radiating far infrared rays have drawn an increasing attention in recent years because the far infrared rays have high penetration force through clothes, etc., and have high heating efficiency.

Metallic heating materials having a high electric resistivity such as a nichrome wire have been mainly used as a heat source of the heaters for radiating the far infrared rays. Carbon powder, ceramics, etc., are disposed on the surface, and when heated, they irradiate the far infrared rays.

In the planar heating units for radiating the far infrared rays, on the other hand, they preferably provide a temperature distribution, which is as uniform as possible, throughout the entire surface thereof. In the heating units using the nichrome wire as the heat source of the planar heating units, therefore, the nichrome wires must be divided into zones as finely as possible and a temperature regulation member such as a thermostat must be disposed for each zone.

To cope with this problem, the applicant of the present device has proposed a planar heating unit using a carbon fiber-mixed sheet. As shown FIG. 6, this planar heating unit 010 is produced by mixing a bast fiber 01 for Japanese paper such as Broussonetia Kazinoki Sieb, Musa Textilio and Edgeworthia Papyrifera with a carbon fiber 02 and by subjecting the mixture to sheet-making. About 5 to about 15% of a PAN-type carbon fiber having a filament diameter of 6.8 $\mu$m and a resistivity of about 20 $\mu\Omega$ is mixed as the carbon fiber. When the sheet-making is carried out by mixing such a bast fiber, a viscous solution extracted from the roots of Hibiscus manihot L. being used as mucilage of Japanese paper is blended.

Electric poles 06, 07 are disposed along side edges 04, 05 of the major sides of a rectangular carbon fiber planar heating unit 010 in the planar heating unit so formed and shown in FIG. 7. for example, and lead wires 08 are connected to terminals provided for the electric poles. When an A.C. voltage of 100 V is applied between both electric poles of the planar heating unit, for example, no critical danger occurs to the human body even when one directly touches the planar heating unit. To produce a practical electric product, however, a synthetic resin sheet 09 is laminated or a suitable synthetic resin thin sheet is bonded to the both surfaces, inclusive of the heating unit portion and the electric poles, and furthermore an aluminum sheet is laminated, in some cases, as shown in FIG. 8 so as to insure waterproofing, moisture proofing, safety, etc., or to prevent damage of the heating unit.

When power is supplied to the carbon fiber so mixed and sheet-made in the planar heating unit, heating occurs due to its resistance. Since the carbon fiber is finely cut and is electrically connected with one another either directly or with very small gaps by the viscous solution extracted from the root of Hibiscus manihot L, etc., a high resistance action takes place at this portion in accordance with the temperature rise, and uncontrolled heating can be prevented.

SUMMARY OF THE INVENTION

As described above, the planar heating unit proposed by the public-known applicant has a difficulty to even the mixed pulp-making of a carbon fiber and a pulp fiber and can not provide automatically a uniform temperature distribution throughout the entire surface of the planar heating unit. Nonetheless, when the planar heating unit in which the carbon fiber is mixed and subjected to sheet-making is used for a long time, the synthetic resin thin plate disposed as a protective cover on the surface of the planar heating unit gradually undergoes discoloration or deterioration, and consequently, service life of the planar heating unit is determined by these defects.

A cause difficult for unifying a blend of a carbon fiber and a pulp fiber results from that at the time of paper-making a refined pulp, the refined pulp is adjusted to a specific concentration, beaten in a refiner as shown in FIG. 9, and blended with 5 to 10 wt. %, preferably about 7%, of a carbon fiber having a fiber cut length of about 6 mm agitated in a stuff chest, and from that the carbon fiber, however, because it has a low density and a low friction coefficient while a high tensile strength and a low breakdown elongation, is not satisfactorily blended with the pulp even agitated in the stuff chest, is distributed unevenly in a sheet making machine. Therefore a carbon fiber in the carbon fiber-mixed sheet prepared may often not be dispersed uniformly.

Accordingly, the present device has an object to provide a heating unit of a carbon fiber-mixed sheet in which carbon fibers are evenly dispersed in the carbon fiber-mixed sheet and a member on which sheet surface does not undergo a degradation such as discoloration and which has a low price.

In order to solve the problem described above, the present device provides a heating unit of a carbon fiber-mixed sheet which sheet has a thickness of 150 $\mu$m or less, a basis weight of 50 g/m$^2$ or less, and a degree of beating of 30~70° SR and is obtained by the mixed sheet making of 5~10 wt. % of a carbon fiber with a length of 5~10 mm and 95~90 wt. 5 of a pulp containing a bast fiber and furthermore one part of which is covered with a sizing agent.

Having the construction described above, the carbon fiber-mixed sheet according to the present device can automatically form a uniform temperature distribution throughout the entire surface and does not undergo discoloration or degradation in the course of use from a long time, so that it becomes more economical.

DETAILED DESCRIPTION OF THE PREFERRED EMBODIMENT

The embodiments of the present invention will now be described with reference to the drawings.

A heating unit of a carbon fiber-mixed sheet according to the present device, having resulted from further studying public known devices described above, the pulp to be mixed with a carbon fiber has to contain 30 wt. % of a pulp containing such a bast fiber as, for example, as Broussonetia Kazinoki Sieb, Edgeworthia Papyrifera, Musa Textillo, and Sasas of Sasa kurilensis (Rupr.) of the genus of sasa, the remainder of the pulp may be used of a Kraft pulp.

On the other hand, it has been found out that the use of Hydrangea paniculata is preferable to other public known sizing agents such as starch, CMC, poly (vinyl alcohol) as sizing solutions, for mutual fixation of fiber such as the carbon fiber. This sizing agent is produced in the following way. The trunks and branches of the Hydrangea paniculata are collected, their outer barks are removed, and the inner barks so obtained are cut. The inner barks are put into a cloth bag and are immersed in water for a night. After they are put into a bag, they are crumpled and squeezed to collect a viscous liquid. When the pulp material is mixed with the carbon fiber, this sizing agent is mixed at a mixing ratio of about 10 cc to 2 liters of the pulp solution. Alternatively, a poly (vinyl alcohol)-based hydrophilic synthetic sticking agent or a polyester-based or polyolefin-based hydrophobic synthetic sticking agent may be used at a similar blend ratio.

Figure 1:
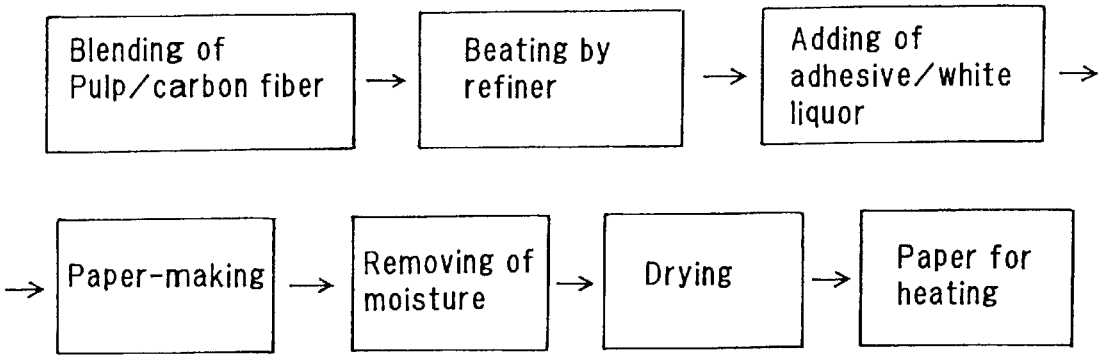
FIG. 1 is a flow diagram showing a paper-making process in one example of the present device.

To conduct a sheet-making from the refining pulp described above, the refining pulp is first prepared to provide a predetermined concentration and is then beaten by a refiner as shown in FIG. 1. Next, about 5~15 wt. %, preferably 7 wt. %, of a carbon fiber cut into a fiber length of about 6 mm is blended, and a stuff chest stirs the mixture. The raw material for sheet making includes 8 kg of the carbon fiber having a diameter of 5~15 $\mu$m and a fiber length of 5~10 mm, preferably 6 mm, with a concentration of 5 kg/m$^3$ and about 121 kg of the pulp. Thereafter, the carbon fiber, the pulp, the sizing solution and other additives such as white liquor, a dispersing agent are mixed to prepare a carbon fiber-mixed sheet of Sasa paper, and the mixture is subjected to sheet-making by a paper machine having a machine wire of 50 mesh. A carbon fiber-mixed sheet which has a feeling of a Japanese paper and has a basis weight of about 50 g/m$^2$ or less, preferably about 30 g/m$^2$ and a thickness of 150 $\mu$m or less, preferably about 60 $\mu$m or less, and a degree of beating of 30~70 ° SR, can be obtained through known pressing and drying processes.

Determining a blend ratio of a carbon fiber to the pulp of 5~10 wt. % makes possible to maintain an electric resistance value and a surface temperature of the mixed sheet at the predetermined values. In order to make easy to radiate the heat from the carbon fiber, a paper containing a carbon fiber and a bast fiber for the mixed sheet is recommended to have a thickness of 150 $\mu$m or less, a basis weight of 50 g/m$^2$ or less, preferably about 30 g/m$^2$. A thick and dense mixed sheet is difficult for controlling a rise in the temperature.

In addition, when carbon fibers are cut into a fiber length of 5 mm or less, the mixed sheet is short in the electric conductivity, not reaching a required heating value. On the other hand, carbon fibers with a fiber cut length of 15 mm or longer, for example 20 mm or more, are badly dispersible in a pulp, resulting in causing unevenness as well as instability in the temperature characteristics. A carbon fiber with a fiber cut length of preferable 5~10 mm can control the sheet at a given temperature.

Figure 2:
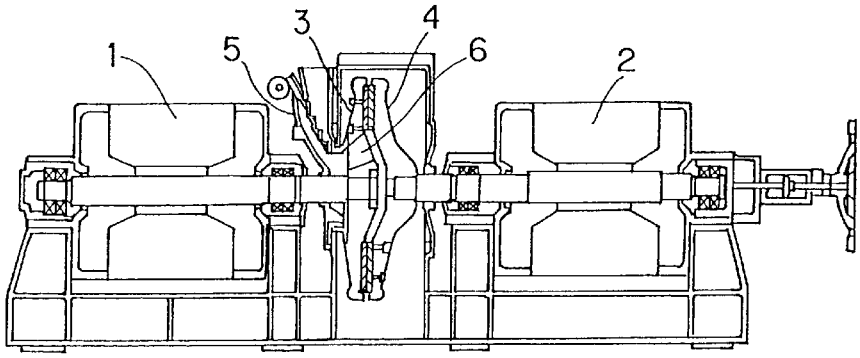
FIG. 2 is a schematic illustration of a double disk refiner used in one example of the present device.

A disk-type refiner can be used as a refiner in this case. For example, a double disk refiner as shown in FIG. 2 can be used. This refiner is operated with disks 3,4, each of which counter rotates by means of two motors 1,2, and a raw material is inserted by pressure between the both disks 3,4 from an opening 6 in the vicinity of the center of the disk 3 by means of a screw feeder 5. Then, a paper material fed into the refiner is rotated by disks 3,4 and to cause a turbulent flow at the time of passing between the both disks 3,4, resulting in that carbon fibers in the paper material are homogeneously dispersed as well as separated and refined as a result of mechanical impact by means of cutting edges of the circular disks 3,4 and then discharged.

Beatings depend upon the number of the cutting edges of the disks 3,4, the number of the revolution, the width of the edges, and a distance between the cutting edges of the both disks. For example, the distance between the cutting edges are gradually shortened, accordingly the beating shows a tendency to desegregation hydration, fibril formation, and cutting. As a result, the distance between the cutting edges of the both circular disks is adjusted to 0.05 mm or more, which is a distance not to cut a carbon fiber.

Figure 3:
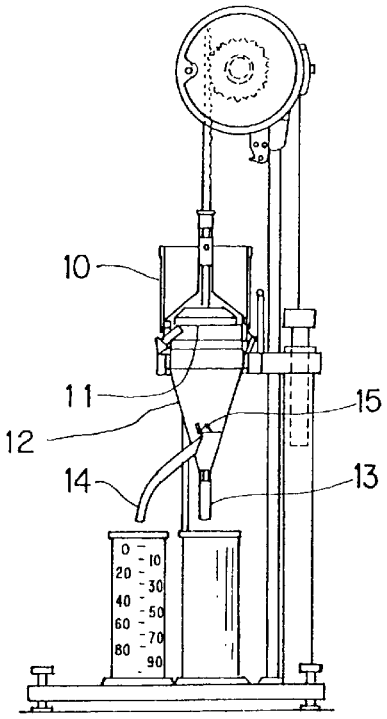
FIG. 3 is a schematic illustration of an Schopper-Riegler type-testing machine used for the present device.

An Schopper-Riegler type-testing machine determines a degree of beating. Schopper-Liegler type tester, as shown in FIG. 3, has at the upper part a filtering cylinder 10, at the lower part of which is put a metal screen 11 having a conical-haped measuring funnel 12 inserted thereunto. The funnel 12 has at the bottom a water outlet 13 and also a side tube 14 at a position somewhat upper the outlet. A dry paper material of 2 g is sampled, which is diluted with 1000 cc of water and mixed well, then charged to the filtering cylinder 10. When a stopper 15 is pulled up, water enters into the measuring funnel 12 through the metal screen 11. At the beginning, a large quantity of water enter to cylinder 16,17 with flowing out of the side tube 14 and the water outlet 13, then when water leak decreases, an outflow from the side tube 14 stops. Letting a quantity of water flowing out through the side tube 14 be x cc, a degree of beating is expressed by the following formula:

$$\text{Degree of beating } (^\circ \text{ SR}) = (1000 - x)/10$$

Figure 4:
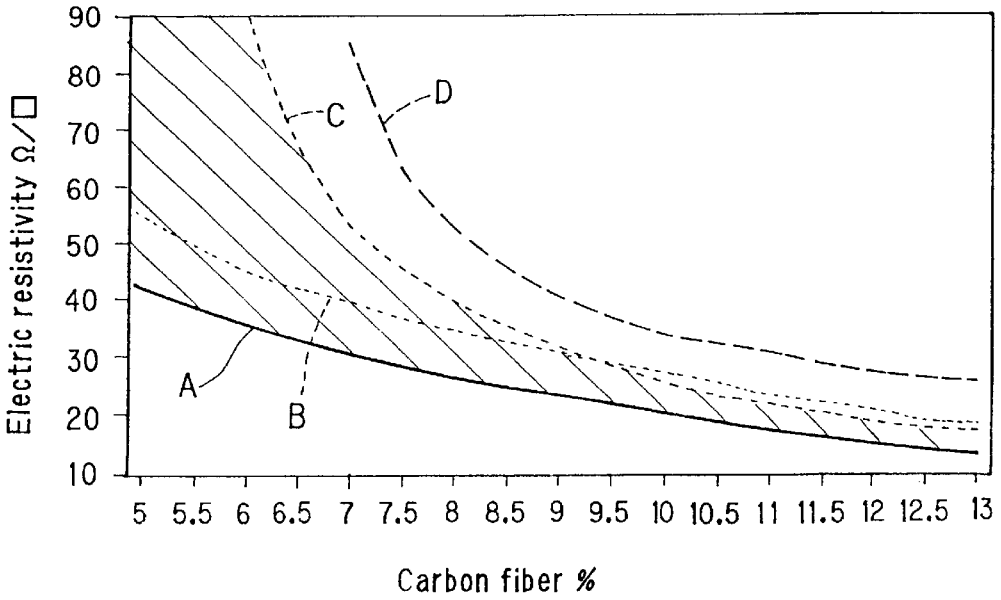
FIG. 4. is a graph showing a relationship between the carbon fiber concentration depending on a degree of beating in a mixed sheet of the present device and the resistivity.

As shown in FIG. 4, a degree of beating being 30° SR or less, an electric resistivity is 40 Ω/□ or less, a mixed-sheet with a basis weight of 40 g/m$^2$ could not rise up to a given temperature, and a degree of beating being 60° SR or more, a mixed sheet with a basis weight of 27 g/m$^2$ and with a mixed ratio of a carbon fiber of 7% or less had an electric resistivity of 80 Ω/□ or more and could not control the temperature to rise. Though belated, FIG. 4 shows tested values on the mixed sheets: a solid line A is for a basis weight of 40 g/m$^2$, a degree of beating of 30° SR; a solid line B for the same basis weight as A and a degree of beating of 60° SR; a solid line C for a basis weight of 27 g/m$^2$ and a degree of beating 30° SR; and a solid line D for the same basis weight as C and a degree of beating of 60° SR.

A carbon fiber-mixed sheet thus obtained has at the side portions electric poles formed in the same way as in the case of prior art papers. This electric pole uses a pole plate of a nickel-plated copper foil and the plates are bonded to the both surfaces the carbon fiber-mixed sheet. The carbon fiber contained in the sheet and the plate are electrically integrated with each other by needle punching. A terminal made of nickel-plated copper or the like is fixed to each electric pole by riveting or caulking, and a lead wire is extended from the terminal. The thickness of the electric pole portion formed in this way is about 35 μm.

Figure 5:
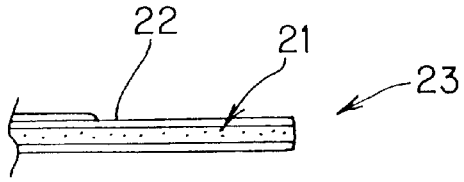
FIG. 5 is a sectional view for a heating unit sheet of a carbon fiber-mixed paper in one example of the present device.
Figure 6:
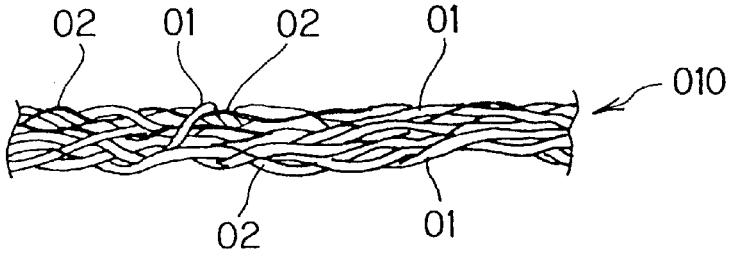
FIG. 6 is an enlarged fragmentary sectional view of a conventional device.
Figure 7:
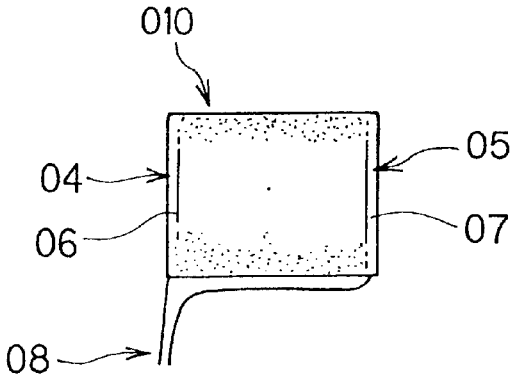
FIG. 7 is a plan view showing a whole constitution of a heating unit of a carbon fiber-mixed paper.
Figure 8:
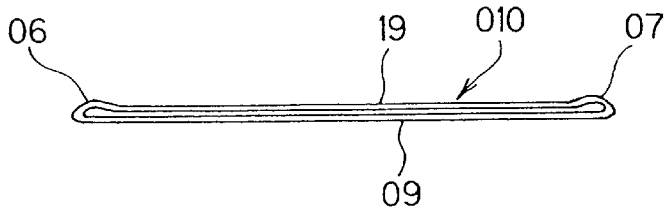
FIG. 8 is a sectional view showing a structure of a heating unit of a carbon fiber-mixed paper.
Figure 9:
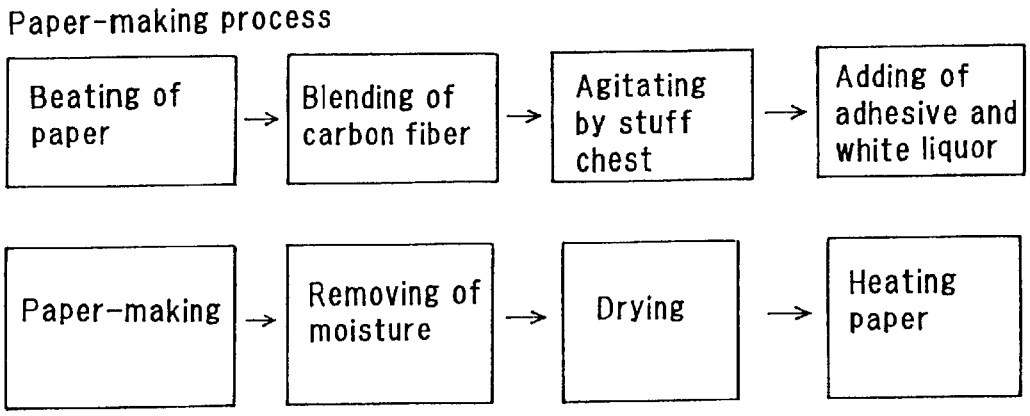
FIG. 9 is a flow diagram showing a conventional paper-making process.

A carbon fiber-mixed paper according to the present device is laminated on the surface with a synthetic resinous sheet for the purpose of the protection of the heating unit. A life of the planar heating unit is determined in such a reason that when the planar heating unit of a carbon fiber-mixed sheet is used for a long time while turning on electricity, it may sometimes be gradually discolored and degraded. A heating unit 23 is contrived and made in FIG. 5 which has a heating unit of a carbon fiber-mixed paper 21 in the inside and has sheets 22 of a polyimide resin as a heat resistant resin laminated onto the both sides of the paper. A thickness of the polyimide resin sheet 22 on the heating unit of a carbon fiber-mixed paper is preferably about 20~30 μm. In addition to this resin, are also used an epoxy resin, a fluororesin, a polyquinolin resin, etc., having a thermal deformation temperature of approximately 300° C.

A heating unit with a carbon fiber-mixed sheet, resulting from the practical preparation described above, has a resistivity of 40 Ω/□ to 80 Ω/□. The paper thickness is 40 μm, being possibly prepared up to 60 μm. A heating unit with a carbon fiber-mixed sheet prepared in a way described above is used as a common panel heating, and besides can be used also as a radiation warming means for warming a whole room inside or as a dew condensation protecting means by setting inside a floor and wall surface.

DESCRIPTION OF EXAMPLES

The followings are preferred examples of the present invention.

Example 1

A raw material comprising 5 wt. % of a carbon fiber having a diameter of 5 μm and a fiber cut length of 5 mm, 95 wt. % of a KP pulp and 1 kg of Hydrangea paniculata was prepared in a concentration of 5 kg/m$^2$, was beaten for 1 hour in a refiner and then made into a paper at a paper-making speed of 10 m/min with a paper-making machine provided with a paper making wire with 50 mesh, then by way of processes of pressing and drying, and wound into a roll of 0.8 m×5000 m with a winding machine. As the result, a carbon fiber-mixed sheet was obtained which has a basis weight of 27 g/m$^2$, a thickness of 60 μm. The above carbon fiber-mixed sheet was cut into 300 mm×180 mm, which was measured for saturated temperatures (atmospheric temperature—elevated temperature) with using a watt meter of Digital multimeter WT 100 YEW (made by Yokokawa Electric Co.) as a measuring instrument and with alternating the voltage. The atmospheric condition was 18° C. and RH 55%, the carbon fiber-mixed sheet had a resistivity of 50 Ω/□. The results are shown in Table 1.

TABLE 1

| | Example 1 | Example 2 | Example 3 | Comparative example 1 | Comparative example 2 |
|---|---|---|---|---|---|
| Carbon fiber % | 5 | 7 | 10 | 4 | 10 |
| Bast fiber % | 0 | 0 | 10 | 65 | 65 |
| Kraft pup % | 95 | 93 | 80 | 30 | 25 |
| Basis weight g/m$^2$ | 27 | 30 | 50 | 60 | 60 |
| Paper thickness μm | 60 | 80 | 90 | 60 | 60 |
| Electric resistivity Ω/□ | 50 | 70 | 80 | 20 | 20 |
| Paper yield % | 100 | 100 | 100 | 90 | 95 |
| Reproducibility | Possible | Possible | Possible | Impossible | Impossible |
| Productivity | Better | Better | Better | Good | Good |

Example 2

A raw material comprising 7 wt. % of a carbon fiber with a diameter of 5 μm and a fiber cut length of 7 mm, 93 wt. % of a KP pulp and 1 kg of poly (vinyl alcohol)-based hydrophilic synthetic sizing agent was prepared in a concentration of 6 kg/m$^2$, with other conditions of the same as those of example 1. As the result, a carbon fiber-mixed sheet was obtained which had a basis weight of 30 g/m$^2$ and a paper thickness of 80 μm. Then a heating unit was made in which 20 μm thick, polyimide resin sheet were laminated onto the both sides of the obtained sheet using a polyimide-based adhesive. The carbon fiber-mixed sheet had a resistivity of 70 Ω□.

Example 3

A raw material was prepared which comprises 10 wt. % of a carbon fiber with a diameter of 10 μm and a fiber cut length of 10 mm, 10 wt. % of a bast fiber, 80 wt. % of a KP pulp and 1 kg of a poly (vinyl alcohol)-based hydrophilic synthetic sizing agent at a ratio of the concentration of 6 kg/m$^2$: the other conditions were the same as those of example 1. As a result, was obtained a carbon fiber-mixed sheet with a basis weight of 50 g/m$^2$ and a thickness of 90 μm. Thereafter a heating unit of a carbon fiber-mixed sheet was obtained in which 30 μm thick polyimide resin sheet were laminated on the both sides of the carbon fiber-mixed sheet using a phenolic resin adhesive. The carbon fiber-mixed sheet had a resistivity of 80 Ω/□.

Comparative Example 1

A raw material consisting of 5 wt. % of a carbon fiber with a diameter of 5 μm and a fiber length of 6 mm, 65 wt. % of a Broussonetia Kazinoki Sieb, 30 wt. % of a Kraft pulp and Hibiscus manihot L. was prepared at a ratio of the concentration of 6 kg/m$^2$, with other conditions being the same as those of example 1. As a result, a carbon fiber-mixed sheet was obtained which had a basis weight of 60 g/m$^2$ and a paper thickness of 60 μm. The sheet had an electric resistivity shown in table 1.

Comparative Example 2

A raw material consisting of 10 wt. % of a carbon fiber with a diameter of 5 μm and a fiber length of 6 mm, 25 wt.

% of a Musa Textilio fiber, 60 wt. % of a Kraft pulp along with a poly (vinyl compound)-based hydrophilic synthetic sizing agent at a ratio of a concentration of 6 kg/m$^2$, with the other conditions being the same as those of example 1. The resistivity is as shown in table 1.

Table 1 shows that paper-making yields of the examples were all 100%, but those of the comparative examples were 95% or less, thus the productivity in the examples were higher than that in the comparative examples, furthermore a temperature rise in the carbon fiber-mixed sheet of the examples are higher than that of the carbon fiber-mixed sheet of the comparative examples.

The present invention, a heating unit of a carbon fiber-mixed sheet, formed described above, obtains a highly rising temperature and a reduced consuming electric power and an even thermal distribution as well as a freed temperature control, with the surface polyimide resin sheet being not subjected to such change of properties as discoloration, and has excellent electric characteristics such as surface resistance and so on. Particularly, the laminating of a thermal resistant resin sheet thereon gives improved such mechanical characteristics as the heat resistance, tensile strength, folding endurance and so on. Furthermore, a heating unit of a carbon fiber-mixed sheet is obtained which sheet has little thermal deformation, excellent chemical resistance, and a low price.

The use of the present invention of a carbon fiber-mixed paper makes possible to radiate a far infrared ray which is fit to a human body and does not give a feel of burning and to have such a clean heating means as giving no harm, no odor, no wind, and no lightening.

What is claimed is:

1. A heating unit of a carbon fiber-mixed sheet which sheet is made by the mixed paper-making of 5~10 wt. % of a carbon fiber with a length of 5~10 mm and 95~90 wt. % of a pulp containing a bast fiber and a part of which sheet is covered with a sizing agent, and which sheet has a thickness of 150 $\mu$m or less, a basis weight of 50 g/m$^2$ or less and a degree of beating of 30~70° SR.

2. A heating unit of a carbon fiber-mixed sheet according to claim 1, wherein said heating unit of a carbon fiber-mixed sheet is laminated with a thermal heat resistant resin sheet.

3. A heating unit of a carbon fiber-mixed sheet according to claim 1 and 2, wherein said carbon fiber has a diameter of 5~10 $\mu$m.

4. A heating unit of a carbon fiber-mixed sheet according to claim 1 or 2, wherein said pulp containing a bast fiber has a fiber length of 3 mm or longer.

5. A heating unit of a carbon fiber-mixed sheet according to claim 3, wherein said pulp containing a bast fiber has a fiber length of 3 mm or longer.

* * * * *